US008879939B2

(12) United States Patent
Zollner et al.

(10) Patent No.: US 8,879,939 B2
(45) Date of Patent: Nov. 4, 2014

(54) METHOD TO OPERATE A DIGITAL PRINTER TO PRINT A RECORDING MATERIAL, AND ASSOCIATED DIGITAL PRINTER WITH MIXING CONTAINER

(71) Applicants: Alfred Zollner, Etting (DE); Franz Kastner, Munich (DE)

(72) Inventors: Alfred Zollner, Etting (DE); Franz Kastner, Munich (DE)

(73) Assignee: Océ Printing Systems GmbH, Poing (DE)

( * ) Notice: Subject to any disclaimer, the term of this patent is extended or adjusted under 35 U.S.C. 154(b) by 24 days.

(21) Appl. No.: 13/862,514

(22) Filed: Apr. 15, 2013

(65) Prior Publication Data

US 2013/0272733 A1 Oct. 17, 2013

(30) Foreign Application Priority Data

Apr. 17, 2012 (DE) ..... 10 2012 103 338

(51) Int. Cl.
*G03G 15/10* (2006.01)

(52) U.S. Cl.
CPC ..... *G03G 15/104* (2013.01)
USPC ..... 399/57; 399/237

(58) Field of Classification Search
CPC .. G03G 15/101; G03G 15/104; G03G 15/105
USPC ..... 399/57, 58, 237, 238
See application file for complete search history.

(56) References Cited

U.S. PATENT DOCUMENTS

| | | | | |
|---|---|---|---|---|
| 6,249,655 | B1 * | 6/2001 | Baek et al. | 399/12 |
| 6,542,704 | B2 * | 4/2003 | Suetsugu | 399/57 |
| 2001/0022901 | A1 | 9/2001 | Suetsugu | |
| 2011/0150534 | A1 | 6/2011 | Kopp | |
| 2011/0286757 | A1 | 11/2011 | Zollner | |

FOREIGN PATENT DOCUMENTS

| | | |
|---|---|---|
| DE | 102008048256 | 4/2010 |
| DE | 102009060334 | 6/2011 |
| DE | 102010015985 | 9/2011 |
| DE | 102010017005 | 12/2011 |
| EP | 0984336 | 3/2000 |

* cited by examiner

*Primary Examiner* — Hoang Ngo
(74) *Attorney, Agent, or Firm* — Schiff Hardin LLP

(57) ABSTRACT

In a method to operate a digital printer having multiple developer stations operated with liquid developer, and wherein a number of the developer stations participating in printing is dependent on a respective print operating mode, liquid developer is supplied from a mixing container to at least one of the developer stations. With a regulatory device a fill level of liquid developer in the mixing container is kept substantially constant depending on the print operating mode. A desired different operating value is provided for the fill level for the regulatory device depending on the operating mode.

12 Claims, 9 Drawing Sheets

| | Umschalten auf Betriebsfall... | | |
|---|---|---|---|
| | A | B | C |
| A | --- | FLSet=50%<br>Param=2%/s | FLSet=15%<br>Param=4%/s |
| B | FLSet=85%<br>Param=2%/s | --- | FLSet=15%<br>Param=2%/s |
| C | FLSet=85%<br>Param=4%/s | FLSet=50%<br>Param=2%/s | --- |

Fig. 9

METHOD TO OPERATE A DIGITAL PRINTER TO PRINT A RECORDING MATERIAL, AND ASSOCIATED DIGITAL PRINTER WITH MIXING CONTAINER

BACKGROUND

The disclosure concerns a method to operate a digital printer to print a recording material with toner particles that are applied with the aid of a liquid developer, in particular a high-speed printer to print web-shaped or sheet-shaped recording media. The disclosure also concerns a digital printer to execute the method.

In such digital printers, a latent charge image of a charge image carrier is inked by means of electrophoresis with the aid of a liquid developer. The toner image that is created in such a manner is transferred indirectly (via a transfer element) or directly to the recording medium. The liquid developer has toner particles and cleaning fluid in a desired ratio. Mineral oil is advantageously used as a cleaning fluid. In order to provide the toner particles with an electrostatic charge, charge control substances are added to the liquid developer. Further additives are additionally added, for example, in order to achieve the desired viscosity or a desired drying behavior of the liquid developer.

Such digital printers have been known for a long time, for example from DE 10 2010 015 985 A1, DE 10 2008 048 256 A1 or DE 10 2009 060 334 A1.

From the document US 2011/0286757 A1 (corresponding to DE 10 2010 017 005 A1), a method is known in which the toner concentration and the fill level in a mixing container are regulated to corresponding desired values via a regulatory arrangement. The desired value for the fill level is the same for all operating modes of the printer and has a relatively high value with regard to the maximum fill level of the mixing container. For example, the mixing container must be able to accommodate the entirety of developer fluid of the developer station connected to it, even in the operating case without active developer station, for which it must be designed to be relatively large in volume. In different operating modes, large volumes of developer fluid must additionally be recirculated with the aid of the regulatory arrangement, which can be problematic for the complete regulatory process, the toner concentration regulation, and therefore the print quality.

SUMMARY

It is an object to specify a method and a digital printer in which a uniform supply of the developer stations with developer fluid and a qualitatively high-grade print result are achieved for different operating modes.

In a method to operate a digital printer having multiple developer stations operated with liquid developer, and wherein a number of the developer stations participating in printing is dependent on a respective print operating mode, liquid developer is supplied from a mixing container to at least one of the developer stations. With a regulatory device a fill level of liquid developer in the mixing container is kept substantially constant depending on the print operating mode. A desired different operating value is provided for the fill level for the regulatory device depending on the operating mode.

BRIEF DESCRIPTION OF THE DRAWINGS

FIG. 9 is a table that shows desired values and parameters upon switching over to different operating modes.

DESCRIPTION OF PREFERRED EXEMPLARY EMBODIMENTS

Figure 1:
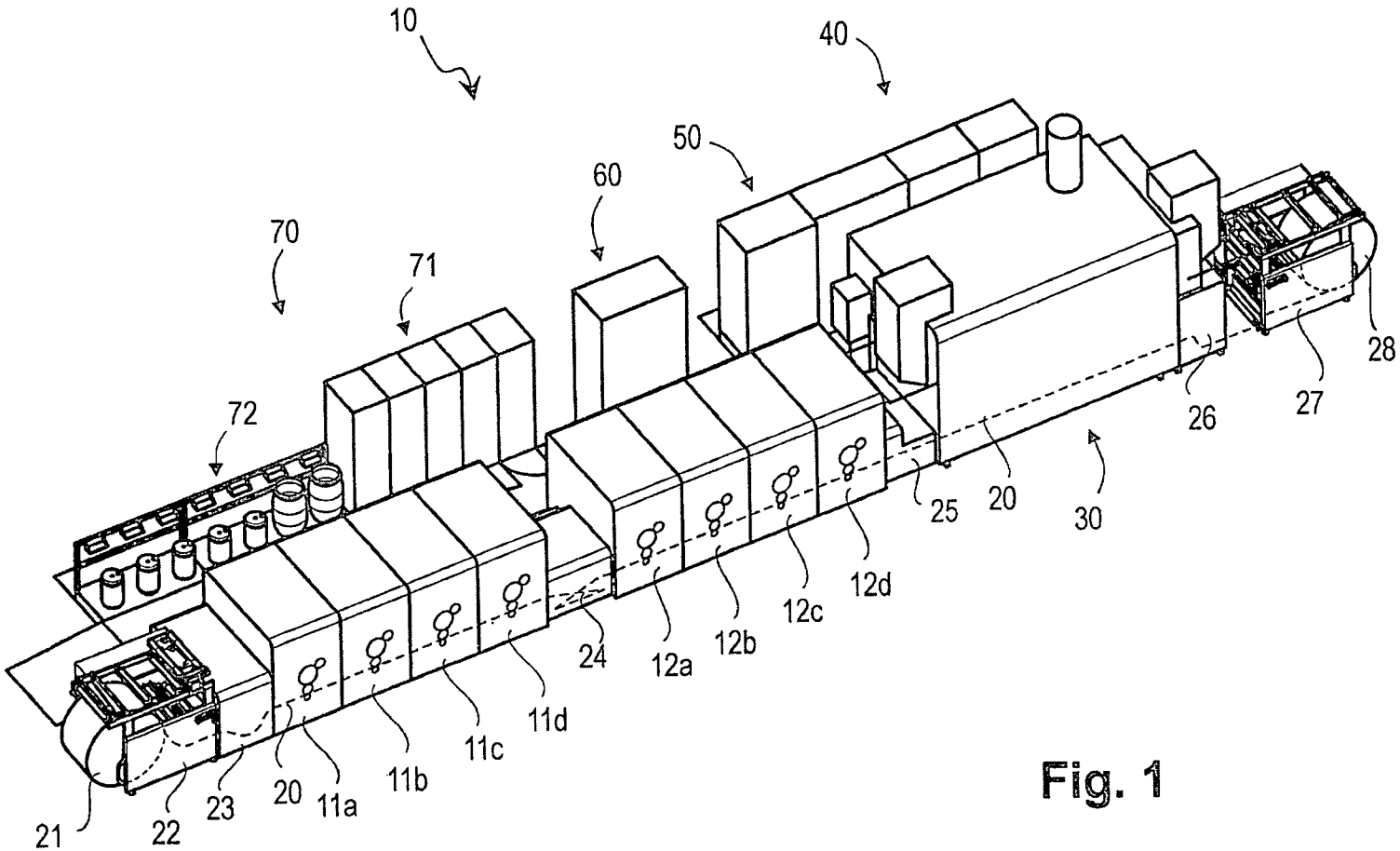
FIG. 1 is a view of a digital printer in an exemplary configuration of the digital printer.

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

In the method according to the exemplary embodiments to operate a digital printer to print a recording medium with toner particles, these are applied with the aid of a liquid developer. As a high-speed printer, such a digital printer comprises one or more developer stations of the same respective toner color that are supplied with liquid developer of consistent toner color from a common mixing container. During the operation of the digital printer, the fill level in the mixing container is to be kept constant so that stable operating conditions are achieved for the required toner concentration regulation and the uniform supply of the connected developer stations. For economic reasons, one or more developer stations are fed from the mixing container, wherein the number of developer stations participating in the printing is dependent on the respective print operation mode. The fill level in the reservoir changes depending on how many developer stations are required for printing, since the liquid developer that is not participating in the printing process must be pumped back into the mixing container via a tube system. The fill level in the reservoir is highest when no developer station is in operation and lowest when all connected developer stations are active. Even when no developer station is active, a fill level regulation is reasonable because in this state the toner concentration is frequently adjusted via the supply of toner concentrate, for which the fill level should maintain a predetermined volume. The volume of the mixing container must be designed so that the liquid developer located in all connected developer stations can be accommodated.

According to exemplary embodiments, different desired operating mode values for the fill level of the regulatory device are provided for the different operating modes. If all developer stations participate in the print operation, and thus if all must be supplied with liquid developer from the mixing container, a low desired value is sufficient for the fill level. This should still be so high that the mixing container cannot run dry or so that air bubbles cannot arrive in the tube system, even given high liquid developer consumption. If none of the connected developer stations is active, the desired value is thus to be set to the highest fill level at which it is ensured that the mixing container will not overflow and liquid developer will not be wasted. Given a change to the operating mode, according to exemplary embodiments the desired operating mode value is adapted to the current operating situation, such that the regulatory device regulates the fill level for this operating mode. In this way the regulatory movements and the recirculation of liquid developer are minimized, whereby the quality of the toner concentration regulation that is required (and therefore the print quality) is improved.

According to one exemplary embodiment, the set desired operating mode value follows a reference value during a transition period, via which an abrupt transition of the fill level between successive operating modes is avoided. The behavior of the reference value over time is chosen so that an overshoot of the regulation of the fill level and/or an overloading of the control elements (in general pumps and valves) is avoided. The reference value is advantageously adjusted so that a time-optimized transient oscillation of the fill level to the new desired value results.

It is advantageous if the reference value follows a time curve in the form of a ramp with predetermined constant rise or constant fall per time unit. The rise or fall of the ramp can be determined via calibration in the operation of the digital printer. The time response of the pumps and the valves can hereby be taken into account.

In addition to this, it is advantageous if the rise and/or the fall of the ramp is adjusted depending on the previous operating mode and the current operating mode. The desired operating mode values belonging to the different operating modes can have different fill levels. The cited measures take this into account in the rise and/or fall of the ramp that is to be set in the transition to a new operating mode under consideration of the maximum pump power of the control element.

Another embodiment of the invention provides that the deviation of real value and reference value during the transition time is determined, and a warning signal is generated upon overshooting a preset maximum value of the deviation. For example, given a failure of a pump, the control element within the regulatory device can no longer reach the desired operating mode value associated with the set operating mode within the predetermined time period, such that a deviation arises. If the maximum value of the deviation is exceeded, this can indicate an error in the system and can be signaled as a warning signal.

According to a further exemplary embodiment of the invention, a digital printer is specified for printing a recording medium. The technical effects that can be achieved with this digital printer corresponding to those that have been described further above in connection with the method.

Exemplary embodiments of the invention are explained in detail in the following using the schematic drawings.

According to FIG. 1, a digital printer 10 for printing a recording medium 20 has one or more print groups 11*a*-11*d* and 12*a*-12*d* that print a toner image (print image 20'; see FIG. 2) on the recording medium 20. As a recording medium 20, a web-shaped recording medium 20 is shown which is unrolled from a roll 21 with the aid of an unroller 22 and is supplied to the first print group 11*a*. In a fixing unit 30, the print image 20' is fixed on the recording medium 20. The recording medium 20 can subsequently be rolled up on a roller 28 with the aid of a take-up stand 27. Such a configuration is also designated as a roll-to-roll printer.

In the preferred configuration shown in FIG. 1, the web-shaped recording medium 20 is printed in full color with four print groups 11*a* through 11*d* on the front side and with four print groups 12*a* through 12*d* on the back side (what is known as a 4/4 configuration). For this, the recording medium 20 is unwound by the unroller 22 from the roll 21 and supplied via an optional conditioning group 23 to the first print group 11*a*. In the conditioning group 23, the recording medium 20 can be pre-treated or coated with a suitable substance. Wax or chemically equivalent substances can advantageously be used as a coating substance (also designated as a primer).

This substance can be applied over the entire surface of the recording medium 20—or only to the points of the recording medium 20 that are to be printed later—in order to prepare the recording medium 20 for the printing and/or to affect the absorption response of the recording medium 20 upon application of the print image 20'. It is therefore ensured that the later applied toner particles or the cleaning fluid do not penetrate too significantly into the recording medium 20, but rather essentially remain on the surface (color quality and image quality are thereby improved).

The recording medium 20 is subsequently initially supplied in order to the first print groups 11*a* through 11*d* in which only the front side is printed. Each print group 11*a*-11*d* typically prints the recording medium 20 in a different color, or also with different toner material (for example MICR toner, which can be read electromagnetically).

After the printing of the front side, the recording medium 20 is turned in a turning unit 24 and is supplied to the remaining print groups 12*a*-12*d* to print the back side. An additional conditioning group (not shown) can optimally be arranged in the region of the turning unit 24, via which the recording medium 20 is prepared for the printing of the back side, for example a fixing (partial fixing) or other conditioning of the previously printed front side print image (or, the entire front side or back side as well). It is thus prevented that the front side print image is mechanically damaged upon additional transport through the subsequent print groups.

In order to achieve a full-color printing, at least four colors (and therefore at least four print groups 11, 12) are required, namely the primary colors YMCK (yellow, magenta, cyan and black), for example. Additional print groups 11, 12 with special colors (for example customer-specific colors or additional primary colors in order to expand the printable colors space) can also be used.

Arranged after the print group 12*d* is a registration unit 25 via which registration marks that are printed on the recording medium 20 independently of the print image 20' (in particular outside of the print image 20') are evaluated. The transverse and longitudinal register (the primary color points that form a color point should be arranged over one another or spatially very closely adjacent to one another; this is also designated as color register or four-color register) and the register (front side and back side must spatially coincide precisely) can thereby be adjusted so a qualitatively good print image 20' is achieved.

Arranged after the registration unit 25 is the fixing unit 30 via which the print image 20' is fixed on the recording medium 20. In electrophoretic digital printers, a thermo-dryer is advantageously used as a fixing unit 30 that largely evaporates the cleaning fluid so that only the toner particles remain on the recording medium 20. This occurs under the effect of heat. The toner particles on the recording medium 20 can thereby also be fused insofar as they have a material (resin, for example) that can be fused as the result of a heating effect.

Arranged after the fixing unit 30 is a feed group 26 that pulls the recording medium 20 through all print groups 11*a*-12*d* and the fixing unit 30 without an additional drive being arranged in this region. The danger that the print image 20' that has not yet been fixed could be smeared would exist due to a friction feed for the recording medium 20.

The feed group supplies the recording medium 20 to the take-up stand 27 that rolls up the printed recording medium 20.

Centrally arranged in the print groups 11, 12 and the fixing unit 30 are all supply devices for the digital printer 10, such as climate control modules 40, power supply 50, controller 60, modules for fluid management 70, fluid control unit 71 and storage reservoir 72 of the different fluids. In particular, pure carrier fluid, highly concentrated liquid developer (high proportion of toner particles in relation to the cleaning fluid) and serum (liquid developer plus charge control substances) are required as liquids in order to supply the digital printer 10, as well as waste reservoirs for liquids to be disposed of or containers for cleaning fluid.

The digital printer 10 is of modular design with its structurally identical print groups 11, 12. The print groups 11, 12 do not differ mechanically, but rather only in the liquid developers that are to be used in them (toner color or toner type).

Figure 2:
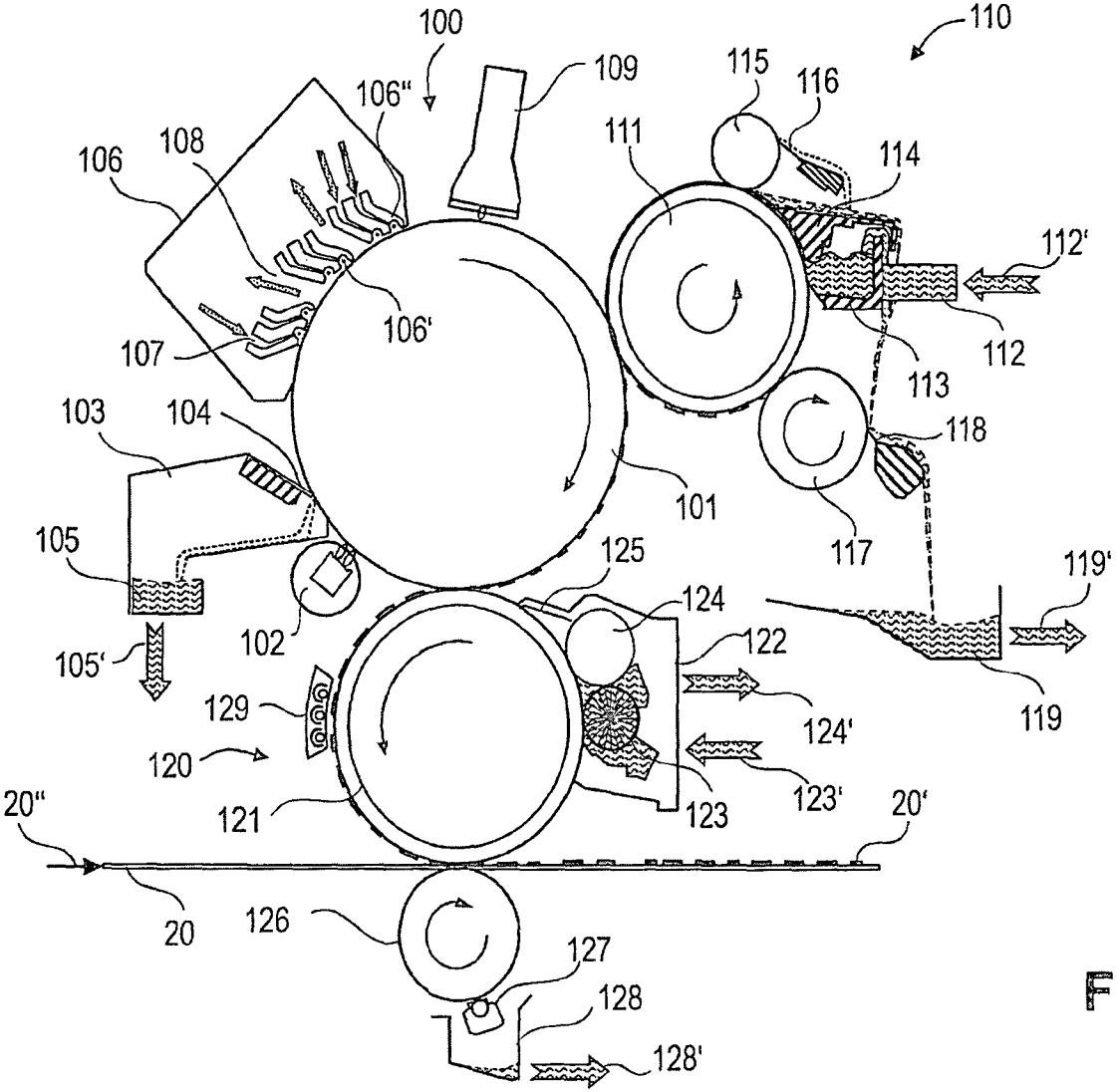
FIG. 2 is a schematic design of a print group of the digital printer according to FIG. 1.

The design of a print group 11, 12 in principle is shown in FIG. 2. Such a print group is based on the electrophotographic principle, in which a photoelectric image carrier is inked with charged toner particles with the aid of a liquid developer and the image that is created in such a manner is transferred to the recording medium 20.

The print group 11, 12 essentially comprises an electrophotography station 100, a developer station 110 and a transfer station 120.

The core of the electrophotography station 100 is a photoelectric image carrier that has on its surface a photoelectric layer (what is known as a photoconductor). Here the photoconductor is designed as a roller (photoelectric roller 101) and has a hard surface. The photoelectric roller 101 rotates past the various elements to generate a print image 20' (rotation in the direction of the arrow).

The photoconductor is initially cleaned of all contaminants. For this, an erasing light 102 is present that erases charges that still remain on the surface of the photoconductor. The erasing light 102 can be coordinated (locally adjusted) in order to achieve a homogeneous light distribution. The surface can therefore be pre-treated uniformly.

After the erasing light 102, a cleaning device 103 mechanically cleans off the photoconductor in order to remove toner particles (possibly dirt particles) and remaining cleaning fluid that are possibly still present on the surface of the photoconductor. The cleaned-off cleaning fluid is supplied to a collection reservoir 105. The collected cleaning fluid and toner particles are prepared (possibly filtered) and supplied depending on the color to a corresponding liquid color storage, i.e. to one of the storage reservoirs 72 (see arrow 105').

The cleaning device 103 advantageously has a blade 104 that rests on the generated surface of the photoconductor roller 101 at an acute angle (for instance 10° to 80° relative to the outlet surface) in order to mechanically clean off the surface. The blade 104 can move back and forth transverse to the rotation direction of the photoconductor roller 101 in order to clean the generated surface with as little wear as possible on the entire axial length.

The photoconductor is subsequently charged by a charging device 106 to a predetermined electrostatic potential. Multiple corotrons (in particular glass shell corotrons) are advantageously present for this. The corotrons comprise at least one wire 106' at which a high electrical voltage is present. The air around the wire 106' is ionized by the voltage. A shield 106" is present as a counter-electrode. The corotrons are additionally flushed with fresh air that is supplied via special air channels (air feed channel 107 for ventilation and exhaust channel 108 to exhaust) between the shields (see also air flow arrows in FIG. 2). The supplied air is then ionized uniformly at the wire 106'. A homogeneous, uniform charge of the adjacent surface of the photoconductor is thereby achieved. The uniform charge is further improved with dry and heated air. Air is discharged via the exhaust channels 108. Ozone that is possibly created can likewise be drawn off via the exhaust channels 108.

The corotrons can be cascaded, meaning that two or more wires 106' are then present per shield 106" given the same shield voltage. The current that flows across the shield 106" can be adjusted, and the charge of the photoconductor can thereby be controlled. The corotrons can be fed with different amounts of current in order to achieve a uniform and sufficiently high charge at the photoconductor.

Arranged after the charging device 106 is a character generator 109 that discharges the photoconductor per pixel via optical radiation, depending on the desired print image 20'. A latent image is thereby created that is inked later with toner particles (the inked image corresponds to the print image 20'). An LED character generator 109 is advantageously used in which an LED line with many individual LEDs is arranged stationary over the entire axial length of the photoconductor roller 101. Among other things, the number of LEDs and the size of the optical image points on the photoconductor determine the resolution of the print image 20' (typical resolution is 600×600 dpi). The LEDs can be controlled individually in terms of time and with regard to their radiation power. Multilevel methods can thus be applied to generate raster points (comprising multiple image points or pixels), or image points are time-delayed in order to implement corrections electro-optically, for example given uncorrected color registration or register.

The character generator 109 has a control logic that must be cooled, due to the plurality of LEDs and their radiation power. The character generator 109 is advantageously liquid-cooled. The LEDs can be activated per group (multiple LEDs assembled into a group) or separately from one another.

The latent image generated by the character generator 109 is inked with toner particles by the developer station 110. For this the developer station 110 has a rotating developer roller 111 that directs a layer of liquid developer towards the photoconductor (the functionality of the developer station 110 is explained in detail further below). Since the surface of the photoconductor roller 101 is relatively hard, the surface of the developer roller 111 is relatively soft, and the two are pressed against one another; a thin, high nip (a gap between the rollers) is created in which the charged toner particles migrate electrophoretically from the developer roller 111 to the photoconductor at the image points due to an electrical field. In the non-image points, no toner transfers to the photoconductor. The nip filled with liquid developer has a height (thickness of the gap) that is dependent on the mutual pressure of the two rollers 101, 111 and the viscosity of the liquid developer. The height of the nip typically lies in the range greater than approximately 2 μm to approximately 20 μm (the values can also change depending on the viscosity of the liquid developer). The length of the nip amounts to a few millimeters, for instance.

The inked image rotates with the photoconductor roller 101 up to a first transfer point at which the inked image is essentially transferred completely to a transfer roller 121. The transfer roller 121 moves to the first transfer point (nip between photoconductor roller 101 and transfer roller 121) in the same direction, and advantageously with identical velocity as the photoconductor roller 101. After the transfer of the print image 20' to the transfer roller 121, the print image 20' (toner particles) can optionally be recharged or charged by means of a charging unit 129 (a corotron, for example) in order to be able to subsequently transfer the toner particles better to the recording medium 20.

The recording medium 20 runs through between the transfer roller 121 and a counter-pressure roller 126 in the transport direction 20". The contact region (nip) represents a second transfer point in which the toner image is transferred to the recording medium 20. In the second transfer region, the transfer roller 121 moves in the same direction as the recording medium 20. The counter-pressure roller 126 rotates in this direction in the region of the nip. The velocities of the transfer roller 121, the counter-pressure roller 126 and the recording medium 20 are matched to one another at the transfer point and are advantageously identical, such that the print image 20' is not smeared. At the second transfer point, the print image 20' is transferred electrophoretically to the recording medium 20 due to an electrical field between the transfer roller 121 and the counter-pressure roller 126. Moreover, the counter-pressure roller 126 presses with high mechanical force against the relatively soft transfer roller 121, whereby the toner particles remain stuck to the recording medium 20 due to the adhesion.

Since the surface of the transfer roller 121 is relatively soft and the surface of the counter-pressure roller 126 is relatively hard, a nip is created upon unrolling, in which nip the toner transfer occurs. Irregularities in the thickness of the recording medium 20 can therefore be equalized, such that the recording medium 20 can be printed without gaps. Such a nip is also well suited to print thicker or more uneven recording media 20, for example as is the case in the printing of packaging.

The print image 20' should in fact transfer to the recording medium 20; nevertheless, a few toner particles can nevertheless undesirably remain on the transfer roller 121. A portion of the cleaning fluid always remains on the transfer roller 121 as a result of the wetting. The toner particles that are possibly still present should be nearly entirely removed by a cleaning unit 122 following the second transport point. The cleaning fluid that is still located on the transfer roller 121 can also be completely removed from the transfer roller 121, or can be removed up to a predetermined layer thickness, so that identical conditions prevail after the cleaning unit 122 and before the first transfer point from the photoconductor roller 101 to the transfer roller 121 due to a clean surface or a defined layer thickness with liquid developer on the surface of the transfer roller 121.

This cleaning unit 122 is advantageously designed as a wet chamber with a cleaning brush 123 and a cleaning roller 123. In the region of the brush 123, cleaning fluid (for example carrier fluid or a separate cleaning fluid are used) is supplied via a cleaning fluid supply 123'. The cleaning brush 123 rotates in the cleaning fluid and thereby "brushes" the surface of the transfer roller 121. The toner adhering to the surface is thereby loosened.

The cleaning roller 124 lies at an electrical point in time that is opposite the charge of the toner particles. As a result of this, the electrically charged toner is removed from the transfer roller 121 by the cleaning roller 124. Since the cleaning roller 123 touches the transfer roller 121, it also removes cleaning fluid remaining on the transfer roller 121, together with the supplied cleaning fluid. A conditioning element 125 is arranged at the outlet from the wet chamber. As shown, a retention plate can be used as a conditioning element 125, which retention plate is arranged at an obtuse angle (for instance between 100° and 170° between plate and outlet surface) relative to the transfer roller 121, whereby residues of fluid on the surface of the roller are nearly completely retained in the wet chamber and are supplied to the cleaning roller 124 for removal via a cleaning fluid discharge 124' to a cleaning fluid reservoir (in the storage reservoirs 72) that is not shown.

Instead of the retention plate, a dosing unit (not shown) can also be arranged there that, for example, has one or more dosing rollers. The dosing rollers have a predetermined clearance from the transfer roller 121 and receive so much cleaning fluid that a predetermined layer thickness arises after the dosing rollers as a result of the squeezing. The surface of the transfer roller 121 is then not completely cleaned off; cleaning fluid of a predetermined layer thickness remains over the entire surface. Removed cleaning fluid is directed via the cleaning roller 124 back to the cleaning fluid storage reservoir.

The cleaning roller 124 itself is mechanically kept clean via a blade (not shown). Fluid that is cleaned off—including toner particles—is captured for all colors via a central collection reservoir, cleaned and supplied to the central cleaning fluid storage reservoir for reuse.

The counter-pressure roller 126 is likewise cleaned via a cleaning unit 127. As a cleaning unit 127, a blade, a brush and/or a roller can remove contaminants (paper dust, toner particle residues, liquid developer etc.) from the counter-pressure roller 126. The cleaned fluid is collected in a collection container 128 and provided again to the printing process (possibly cleaned) via a fluid discharge 128'.

In the print groups 11 that print the front side of the recording medium 20, the counter-pressure roller 126 presses against the unprinted side (and thus the side that is still dry) of the recording medium 20.

Nevertheless, dust/paper particles or other dirt particles can already be located on the dry side that are then removed from the counter-pressure roller 126. For this, the counter-pressure roller 126 should be wider than the recording medium 20. As a result of this, contaminants can also be cleaned off well outside of the printing region.

In the print groups 12 that print to the back side of the recording medium 20, the counter-pressure roller 126 presses directly on the damp print image 20' of the front side that has not yet been fixed. So that the print image 20' is not removed by the counter-pressure roller 126, the surface of the counter-pressure roller 126 must have anti-adhesion properties with regard to toner particles and also with regard to the cleaning fluid on the recording medium 20.

The developer station 110 inks the latent print image 20' with a predetermined toner. For this, the developer roller 111 directs toner particles towards the photoconductor. In order to ink the developer roller 111 itself with a layer over its entire area, liquid developer is initially supplied to a storage chamber from a mixing container (within the fluid control unit 71; not shown) via a fluid feed 112' with a predetermined concentration. Given a surplus, the liquid developer is supplied from this reservoir chamber 112 to a pre-chamber 113 upon overflow (a type of pan that is open at the top). An electrode segment 114 that forms a gap between itself and the developer roller 111 is arranged towards said developer roller 111.

The developer roller 111 rotates through the pre-chamber 113 (open at the top) and thereby carries liquid developer along into the gap. Excess liquid developer runs from the pre-chamber 113 back to the reservoir chamber 112.

Due to the electrical field formed by the electrical point in time between the electrode segment 114 and the developer roller 11, in the gap the liquid developer is divided into two regions, and in fact into a layer region in proximity to the developer roller 111 in which the toner particles concentrate (concentrated liquid developer) and a second region in proximity to the electrode segment 114 that is low in toner particles (very low concentration of liquid developer.

The layer of liquid developer is subsequently transported further to a dosing roller 115. The dosing roller 115 squeezes the upper layer of the liquid developer so that a defined layer thickness of liquid developer of approximately 5 μm subsequently remains on the developer roller 111. Since the toner particles are significantly located near the surface of the developer roller 111 in the cleaning fluid, the outlying cleaning fluid is significantly squeezed out or retained and ultimately is supplied to a collection container 119, but not to the storage container 112.

As a result of this, predominantly highly concentrated liquid developer is conveyed through the nip between dosing roller 115 and developer roller 111. A uniformly thick layer of liquid developer with approximately 40 percent cleaning fluid by mass thus arises after the dosing roller 115 (the mass ratios can also fluctuate more or less depending on the printing process requirements). This uniform layer of liquid developer is transported into the nip between the developer roller 111 and the photoconductor roller 101. There the image points of the latent image are then electrophoretically inked with toner particles, while no toner passes to the photoconductor in the region of the non-image points. Sufficient carrier fluid is absolutely necessary for electrophoresis. The fluid film splits approximately in the middle after the nip as a result of wetting, such that one part of the layer remains adhered to the surface of the photoconductor roller 101 and the other part (essentially carrier fluid for image points and essentially toner particles and carrier fluid for non-image points) remains on the developer roller 111.

So that the developer roller 111 can be coated again with liquid developer under the same conditions and uniformly, toner particles (these essentially represent the negative, untransferred print image) will remain, and liquid developer with be electrostatically and mechanically removed by a cleaning roller 117. The cleaning roller 117 itself is cleaned by a blade 118. The cleaned-off liquid developer is supplied to the collection container 119 for re-use, to which the liquid developer cleaned off of the dosing roller 115 (by means of a blade 116, for example) and the liquid developer cleaned off of the photoconductor roller 101 by means of the blade 104 are also supplied.

The liquid developer collected in the collection container 119 is supplied to the mixing container via the liquid discharge 119'. Fresh liquid developer and clean carrier fluid are also supplied as needed to the mixing container. Sufficient liquid in a desired concentration (predetermined ratio of toner particles to carrier fluid) must always be present in the mixing container. The concentration in the mixing container is continuously measured and regulated accordingly depending on the supply of the amount of cleaned-off liquid developer and its concentration, as well as of the amount and concentration of fresh liquid developer or carrier fluid.

For this, the most highly concentrated liquid developer, pure carrier fluid, serum (carrier fluid and charge control substances in order to control the charge of the toner particles) and cleaned-off liquid developer can be separately supplied to this mixing container from the corresponding storage reservoirs 72.

The photoconductor can preferably be designed in the form of a roller or as a continuous belt. An amorphous silicon can thereby be used as a photoconductor material or an organic photoconductor material (also designated as an OPC).

Instead of a photoconductor, other image carriers (such as magnetic, ionizable etc. image carriers) can also be used that do not operate according to the photoelectric principle, but rather which will electrically, magnetically or otherwise impress latent images according to other principles, which images are then inked and ultimately transferred to the recording medium 20.

LED lines or even lasers with corresponding scan mechanism can be used as a character generator 109.

The transfer element can likewise be designed as a roller or as a continuous belt. The transfer element can also be omitted. The print image 20' is then directly transferred from the photoconductor roller 101 to the recording medium 20.

What is to be understood by the term "electrophoresis" is the migration of the charged toner particles in the carrier fluid as a result of the action of an electrical field. At each transfer of toner particles, the corresponding toner particles essentially completely pass to a different element. After contacting the two elements, the fluid film is approximately split in half as a result of the wetting of the participating elements, such that approximately one half remains adhered to the first element and the remaining part remains adhered to the other element. The print image 20' is transferred and then transported further in the next part in order to allow an electrophoretic migration of the toner particles again in the next transfer region.

The digital printer 10 can have one or more print groups for the front side printing and (if applicable) one or more print groups for the back side printing. The print groups can be arranged in a line, L-shaped or U-shaped.

Instead of the take-up stand 27, post-processing devices (not shown) can also be arranged after the feed group 26, such as cutters, folders, stackers etc. in order to bring the recording medium 20 into the final form. For example, the recording medium 20 could be processed so far that a finished book is created at the end. The post-processing apparatuses can likewise be arranged in series or curved away from this.

As was previously described as a preferred exemplary embodiment, the digital printer 10 can be operated as a roll-to-roll printer. It is also possible to cut the recording medium 20 into sheets at the end and to subsequently stack the sheets, or to further process them in a suitable manner (roll-to-sheet printer). It is likewise possible to feed a sheet-shaped recording medium 20 to the digital printer 10, and to stack the sheets or process them further at the end (sheet-to-sheet printer).

If only the front side of the recording medium 20 is printed, at least one print group 11 with one color is thus required (simplex printing). If the back side is also printed, at least one print group 12 is also required for the back side (duplex printing). Depending on the desired print image 20' on the front side and back side, the printer configuration includes a corresponding number of print groups for front side and back side, wherein every print group 11, 12 is always designed for only one color or one type of toner.

The maximum number of print groups 11, 12 is only technically dependent on the maximum mechanism draw load of the recording medium 20 and the free feed length. Arbitrary configurations are typically possible, from a 1/0 configuration (only one print group for the front side to be printed) to a 6/6 configuration in which six print groups can respectively be present for the front side and back side of the recording medium 20. The preferred embodiment (configuration) is shown in FIG. 1 (a 4/4 configuration), with which full-color printing with the four primary colors is produced for the front side and back side. The order of the print groups 11, 12 in four-color printing advantageously proceeds from a print group 11, 12 that prints in light color (yellow) to a print group 11, 12 that prints in dark color, thus for example that prints the recording medium 20 in the color order Y-C-M-K from light to dark.

The recording medium 20 can be produced from paper, metal, plastic or other suitable and printable materials.

The subsequent Specification in particular concerns the fluid management module 70 shown in FIG. 1—in particular the fluid control unit 71—which accesses storage reservoirs 72 that include carrier fluid, highly-concentrated liquid developer and charge control substances. At least two print groups 11, 12 of these print to the front side of the recording medium 20 and to its back side with the same toner color. The associated print groups can be supplied from a common mixing container 130 (FIG. 3) with regard to the supply with liquid developer and be operated with a common controller. For example, the print group 11*a* can print the color Y (yellow). The print group 12*a* can likewise accordingly print the color Y, and the associated developer stations can be supplied with toner of the color Y from a common mixing container. For digital printing 10, in FIG. 1 a structurally identical digital printer 10 can be provided in a parallel arrangement. In this case it would be conceivable to supply three or four developer stations with liquid developer from a common mixing container.

Figure 3:
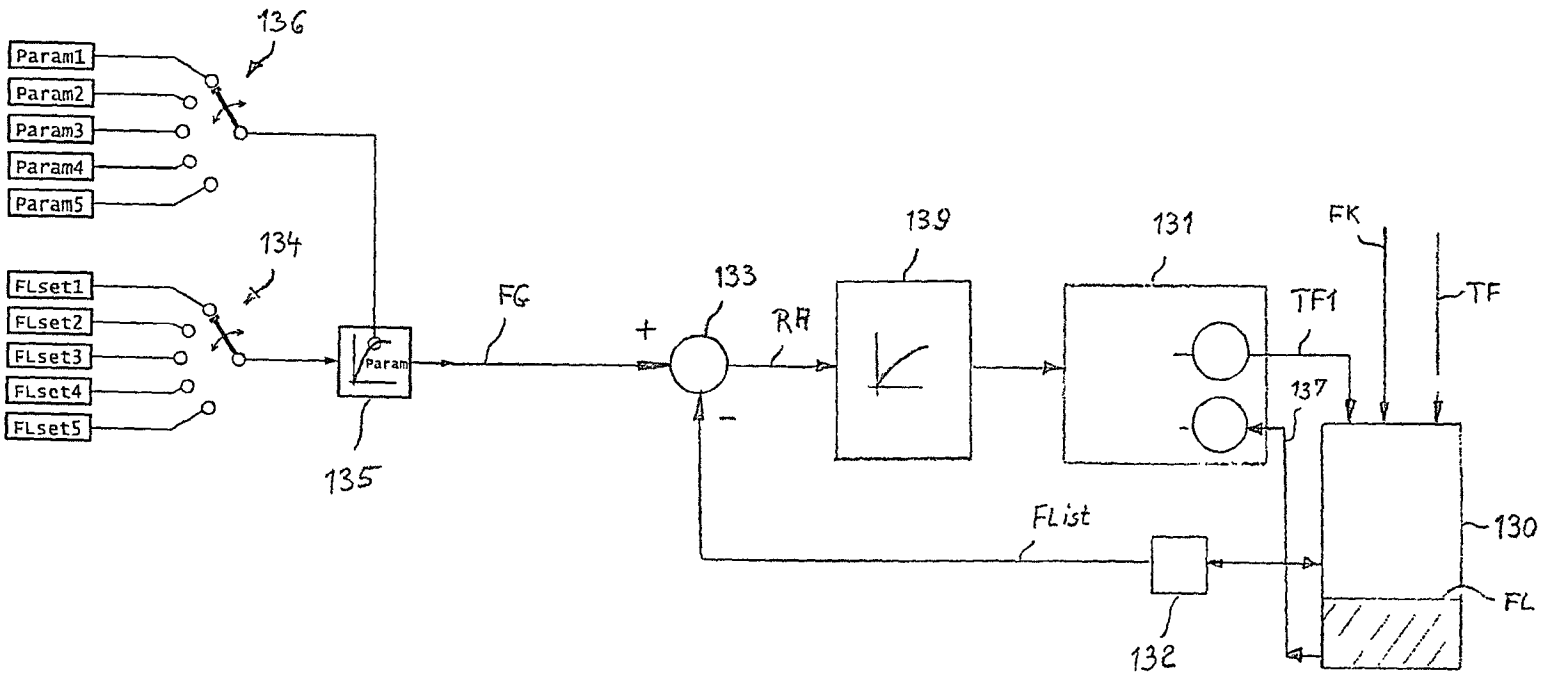
FIG. 3 is a block diagram for the fill level regulation with desired value switching.

FIG. 3 shows an exemplary embodiment for a regulatory arrangement to regulate the fill level FL in a mixing container 130. Pure carrier fluid TF and highly concentrated liquid developer concentrate FK (which has a high proportion of toner particles in relation to the carrier fluid) are supplied from the storage reservoirs 72 to this mixing container 130. Furthermore, re-processed carrier fluid TF1 is supplied via a control element 131, which re-processed carrier fluid TF1 is supplied back into the collection container 119 (FIG. 2) via the fluid discharge 119'. The pure carrier fluid TF, the resupplied fluid TF1 and the liquid developer concentrate FK are mixed in the mixing container 130, and a concentration (predetermined ratio of toner particles to carrier fluid) required for printing is adjusted via regulation. This regulation of the toner concentration is described in DE 10 2010 017 005 A1, the content of which is to be added to the disclosure content of the present Application.

The real fill level FLreal is measured with the aid of a sensor 132, converted into corresponding electrical signals and supplied to an adder element 133. Via a cross-over switch 134, one of the values FLset1 through FLset5 is supplied to this as a desired value via an electrical filter unit 135. These values FLset1 through FLset5 are dependent on an operating mode set via the controller of the digital printer 10. In practice, the cross-over switch 134 is realized in software via assignment of the corresponding value to a variable. In the shown position of the cross-over switch 134, the desired operating mode value FLset1 is supplied to the filter unit 135 whose time response is affected by parameters Param1 through Param5. These values are supplied to the filter unit 135 via an additional cross-over switch 136. In practice, the additional cross-over switch 136 is likewise realized as a software function. The filter unit 135 generates a reference variable FG from the desired operating mode values FLset1 through FLset5 under consideration of the values Param1 through Param5, which reference variable FG has such a curve during a transition time that they only reach the set desired operating mode value after the expiration of the transfer time. The interaction of the desired operating mode values FLset1 through FLset5 and the values Param1 through Param5 with the filter unit 135 is explained in detail further below.

At the adder element 133, the control deviation RA is formed from the difference of reference variable FG or desired operating mode values FLset1 through FLset5 and real fill level value FLreal, which control deviation RA is supplied to a regulator 139 with an adjustable control response (PID response, for example). The output signal of the regulator 139 activates a control element 131, generally pumps and/or valves which supplies carrier fluid TF1 to the mixing container 130, whereby the fill level is increased, or developer fluid is removed via the conduit 137 in order to supply the connected developer stations and reduces the fill level FL. Control elements (not shown) that control the infeed of carrier fluid TF and the liquid developer concentrate also belong to this control element 131.

Figure 4:
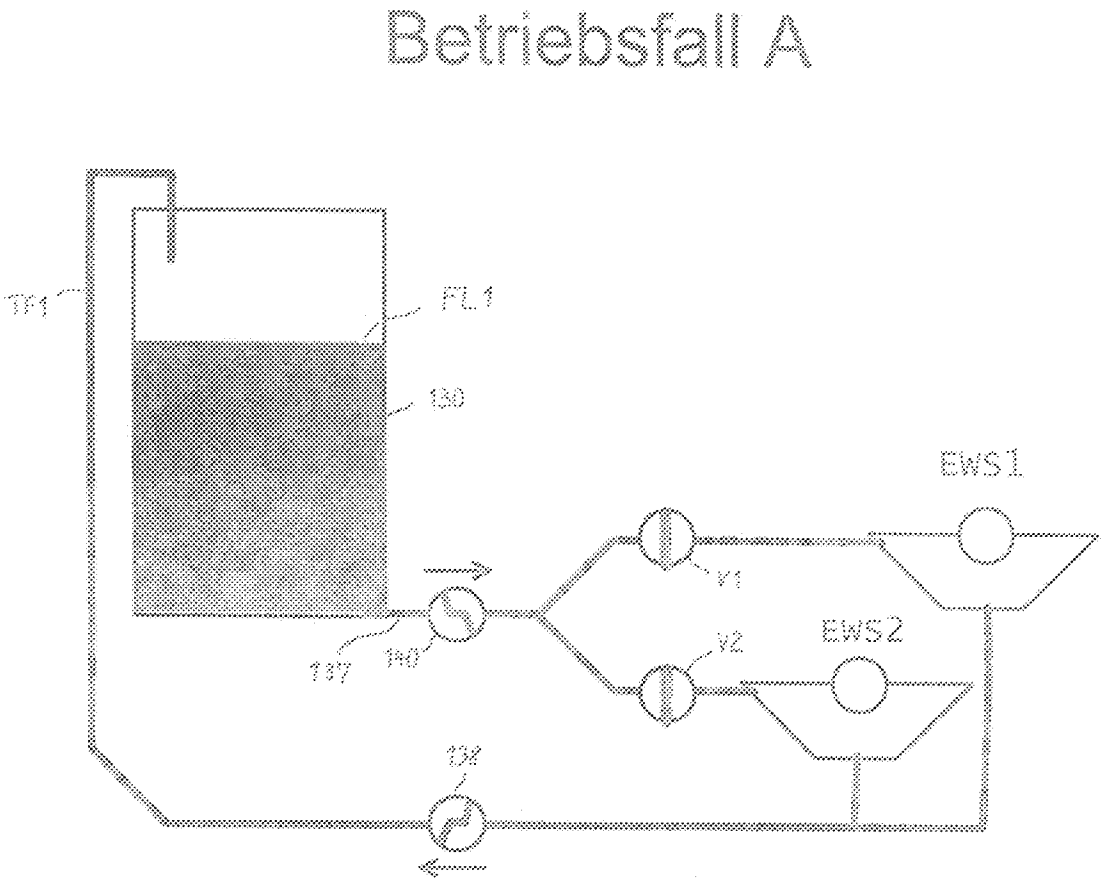
FIG. 4 illustrates schematically an operating mode with inactive developer stations.
Figure 5:
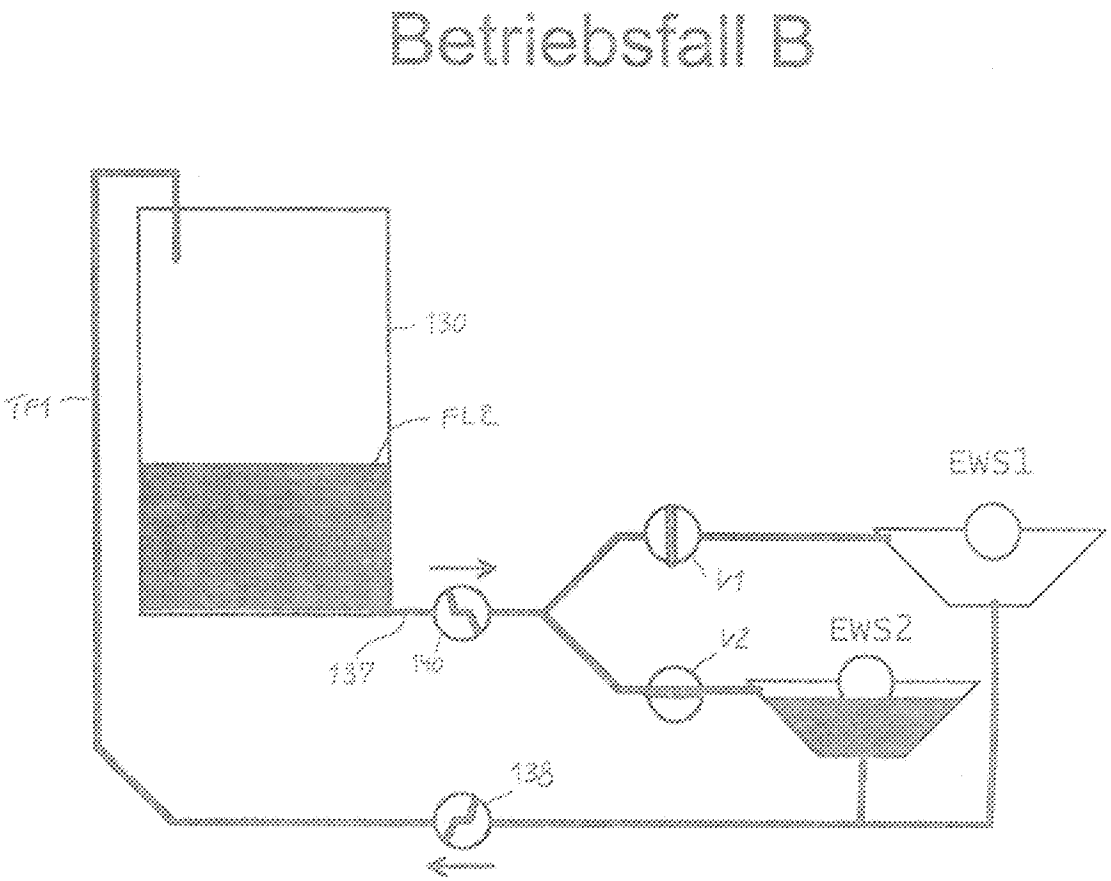
FIG. 5 illustrates an operating mode with only one activated developer station.
Figure 6:
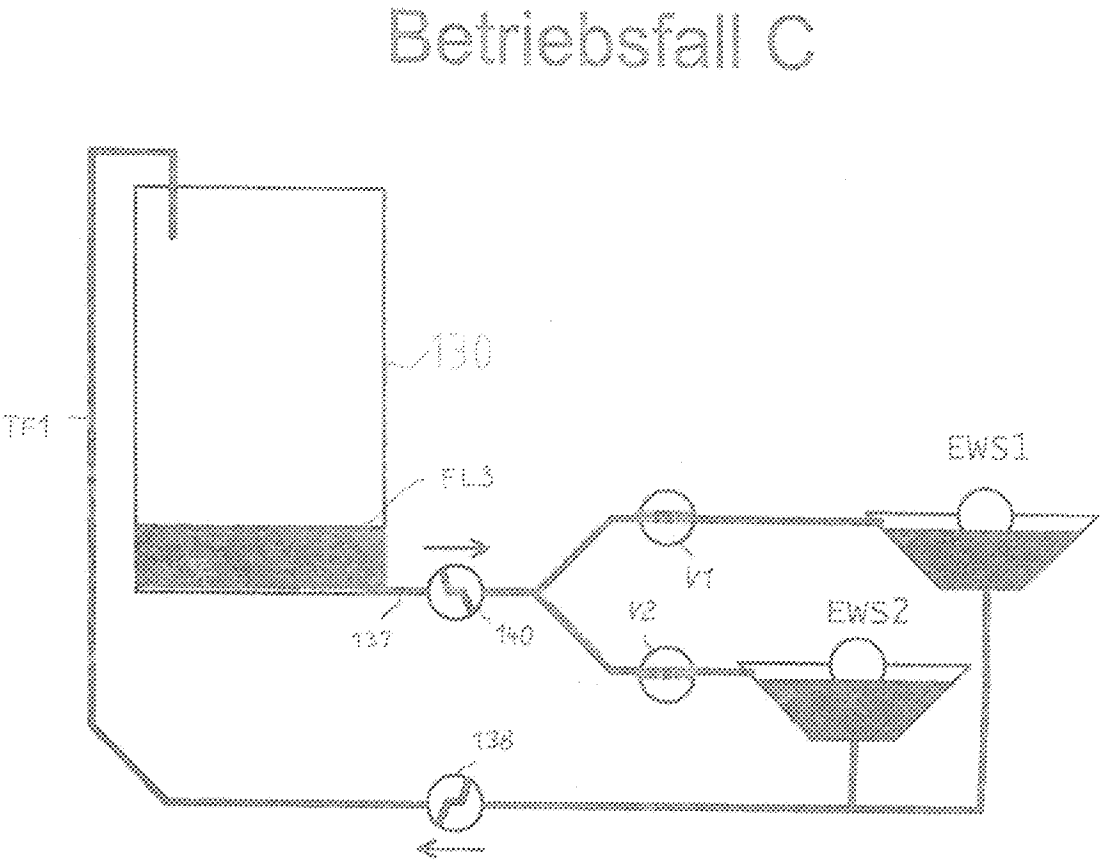
FIG. 6 illustrates an operating mode with two activated developer stations.

FIGS. 4, 5 and 6 show three operating modes, wherein two developer stations EWS1 and EWS2 are to be supplied with developer fluid from the mixing container 130. FIG. 4 shows the operating case A in which all developer stations EWS1 and EWS2 are not active and have been emptied. Valves V1 and V2 via which the developer stations EWS1 or EWS2 are supplied are closed. A return pump 138 pumps the developer fluid into the mixing container 130, which has a high fill level because the entirety of the developer fluid is located in this mixing container 130. In this state, the supply pump 140 is deactivated because a supply of developer fluid is not required.

FIG. 5 shows the operating case B in which the developer station EWS1 is not active and valve V1 is closed. The supply pump 140 is activated and conveys liquid developer via the valve V2 to the active developer station EWS2. During the printing operation, the return pump 138 conveys recovered liquid developer TF1 back into the mixing container 130. Assuming the operating case A, in FIG. 4 liquid developer is conveyed out of the mixing container 130 via the supply pump 140 and the open valve V2 so that the fill level in the mixing container 130 decreases with a time delay to a lower fill level FL2.

The lowest fill level (fill level FL3) results when all developer stations (two developer stations EWS1 and EWS2 in the present case are active simultaneously and receive liquid developer via the supply pump 140. In FIGS. 4, 5 and 6, pumps 138, 149 and valves V1, V2 are shown as elements of the control element 131 in the regulatory arrangement according to FIG. 3. This is to be understood merely as a simple example; additional elements and different arrangements are comprised by the exemplary embodiment.

According to the exemplary embodiment, for each operating case A, B, C a suitable desired operating mode value FLset1 through FLset5—to which the control arrangement according to FIG. 3 constantly regulates the fill level FL after the expiration of the transfer time—is provided by the controller of the printer 10. In the present simple example, only three desired values are required; however, additional desired values can be provided for further possible operating states and for further developer stations.

According to FIG. 3, the desired value, set depending on the operating mode, is affected in its time response by the filter unit 135, wherein its response is established by the parameters Param1 through Param5. The filter unit 135 generates the reference variable FG, which approaches the set desired operating mode value during a transfer time. An abrupt transition of the fill level between successive operating modes is avoided in this way.

Figure 7:
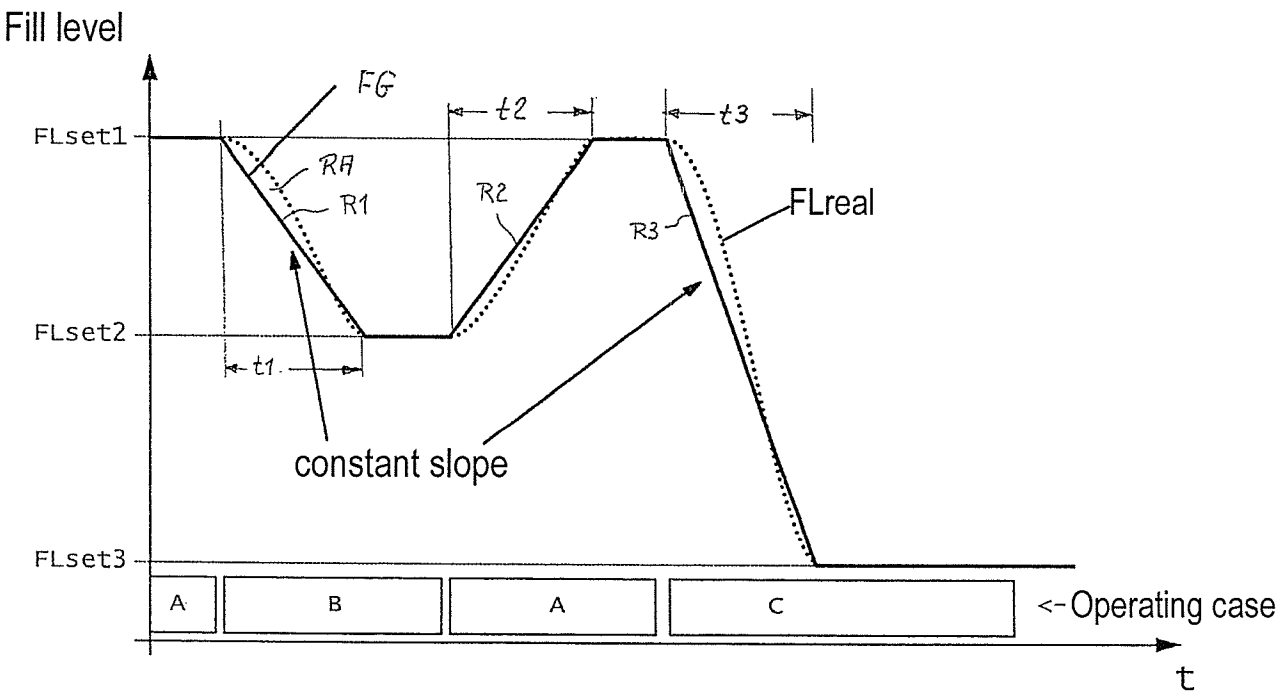
FIG. 7 illustrates the curve of reference values, desired values and real values in different operating modes.

FIG. 7 shows the effect of the filter unit 135 in a time curve over different operating modes. The time t is plotted along the X-axis as abscissa, and different operating cases A, B and C (as explained above) are provided for defined durations. The associated desired values for the three operating modes A, B, C are drawn on the ordinate as FLset1, FLset2 and FLset3. Upon switching from operating mode A to operating mode B, the fill level FL in the mixing container 130 is to be changed from FLset1 to FLset2. An abrupt change would possibly cause the control loop to fluctuate and/or overload the elements of the control units (valves, pumps). For this reason, the new desired operating mode value FLset2 is not directly passed to the adder element 133, but rather the reference variable FG. This reference variable FG has the curve of an edge R1 with a predetermined, constant slope in the transition time t1, namely from the setting of the new operating mode B up to the achievement of the desired value FLset2 belonging to this operating mode B. This slope is established so that it corresponds to the real curve of the fill level given an absolute control of the elements of the control units (pumps, valves). The slope of the ramp R1 is achieved via the set parameters Param1 through Param5. The set value—for example Param1—is to be matched to the actual speed of the decline of the fill level that can be achieved with the control elements that are used (pumps, valves, tube system), and therefore to the volume current for the liquid developer. After the transition time t1 has elapsed and the desired value FLset2 has been reached, the fill level FL is kept constant by the regulatory arrangement (FIG. 3) for the duration of the operating mode B. During the transition period t1, the real fill level value Freal follows the reference variable FG with a small regulatory deviation RA.

Given a transition from operating mode B (a developer station EWS1 is active) to operating mode A (no developer station is active), it is accordingly assumed, wherein the reference variable FG has an edge R2 with predetermined constant slope during the transition time t2, however. The curve of the edge R2 is adjusted by means of the values Param1 and Param5. After expiration of the transition period t2, the desired value FLset1 appears. The real value Freal does not exactly follow the reference variable FG due to the control response of regulator, control element and sensor. An optimum of the regulatory deviation can be achieved via variation of the values Param1 through Param5, the rise or, respectively, fall of the edge R2.

In the transition from operating mode A to operating mode C, the reference variable FG likewise has the curve of an edge R3 with a constant slope during the transition period t3. After the expiration of the transition time t3, the fill level FL in the mixing container 130 is constantly regulated to the desired value FLset3.

A calibration process is advantageous to determine advantageous desired operating mode values FLset1 through FLset5 and the parameters Param1 through Param5 that affect the filter unit 135. The desired operating mode values FLset1 through FLset5 should correspond to fill levels that appear when an advantageous operating state is achieved via manual or semi-automatic control. All inflows or outflows should be blocked to determine these desired values, meaning that the fill level regulation and a possible toner concentration regulation should be deactivated. The values for Param1 through Param5 can be determined via a chronological measurement, wherein how fast the fill level rises or falls per time unit is to be determined for each pump or each valve. In this way the entire regulatory arrangement for the fill level regulation can be adjusted for an optimal operation in different operating modes.

An additional simple possibility to avoid an abrupt transition of the fill level FL between two successive operating modes is also to be noted in which the reference variable FG has a low-pass curve. The time constants for this low-pass for the transition between different operating modes can be determined via calibration.

If the reference variable FG is chosen so that it satisfies real conditions upon switching from one operating mode to another—meaning that the decrease of the reference variable FG or its increase is chosen so that the elements of the control unit (pumps, valves, conduit system) and the regulatory response of the regulatory unit (regulator, sensor) can follow this reference variable FG during the transition time t1, t2, t3 under normal operating conditions—then under these assumptions the regulatory deviation RA between real value FLreal and reference variable FG or (after expiration of the transition period t1 through t3) the desired operating mode value FLset1 through FLset3 can be used for monitoring and error detection. The deviation of real value and reference variable or desired operating mode value is hereby determined, and a warning signal is generated upon exceeding a maximum value of the deviation.

Figure 8:
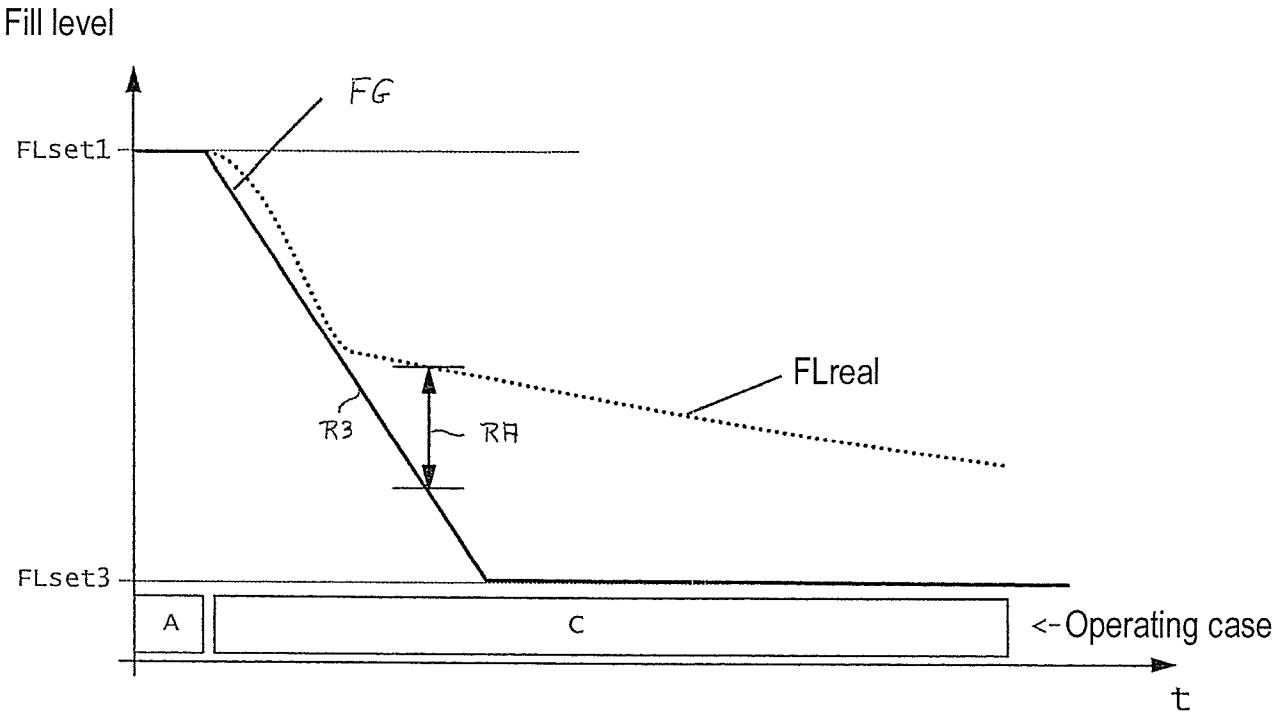
FIG. 8 illustrates the curve of reference value, desired value and real value given failure of a pump.

FIG. 8 shows an example of this. Starting from an operating mode A (see Figure), a switch to the operating mode C takes place, controlled by the controller of the digital printer 10. The associated desired operating mode values are FLset1 or FLset3. During the transition time, the reference variable FG is active in the form of the decreasing ramp R3 with a slope established by one of the parameters Param1 through Param5. The real value FLreal initially follows this curve of the reference variable FG. Due to a failure of a pump, the real value FLreal is removed from the reference variable FG and the decrease of the fill level FL is slowed. This deviation RA is determined. If this deviation RA exceeds an adjustable maximum value, the controller reports an error. The maximum value of the deviation is established by calibrating the system or by experience.

Using a table, FIG. 9 shows concrete values for desired operating mode values and associated parameters for the filter unit 135 which determines the reference variable FG. The specified values for the parameters are indicated in percentile values per second and define the rise or the fall of the edge for the reference variable FG during the transition period. The desired operating mode values FLset are indicated in percent of the maximum fill level of the mixing container 130. As shown in FIGS. 4 through 6, with a mixing container 130 in the selected example at most two developer stations EWS1 and EWS2 are supplied with liquid developer. In this operating mode C, the fill level of the mixing container 130 amounts to approximately 15% of the maximum fill level of the mixing container 130. The real level FLreal for the operating mode C typically lies between 10% and 20% and is regulated to the desired value FLset=15%, corresponding to the regulation unit. At lower fill levels, as indicated the danger exists that the mixing container 130 runs empty, and air arrives in the conduit system.

In operating mode A (no developer station is active), the fill level in the mixing container 130 increases to the maximum value. For example, such an operating mode A can be present when service tasks are to be executed at the developer stations. The real value FLreal in the mixing container 130 then typically lies in a range from 70% to 90% of the maximum fill level. FLset=85% is provided as a desired value for this operating state in order to have sufficient reserves. Given a higher fill level, the danger exists that the mixing container 130 overflows given disadvantageous regulatory response, and developer fluid must be disposed of as waste.

In operating mode B (only one developer station is active), the typical real value FLreal of the fill level is situated approximately in the middle of the mixing container 130, and the desired value FLset is at 50%.

In the table according to FIG. 9, suitable values for the desired operating mode value FLset and the parameters Param for the transitions of the different operating modes are specified in %/s relative to the maximum fill level. For example, the edge at the transition from operating mode A to operating mode B is defined by FLset=85% and Param=2%/s, and the edge for the transition from operating mode A to operating mode C is defined by FLset=85% and Param=2%/s.

Significant technical advantages result given application of the present exemplary embodiments. In the different operating modes, the respective desired values are placed close to real operating points that would arise given an absolute control. In this way, the fill level regulation operates in a realistic fill level range, whereby the precision of a regulation of the toner concentration is improved, via which consumed toner is updated in the printing process.

Via the exemplary embodiments it is possible to operate a number of developer stations with a single mixing container and a uniform regulatory device, although the fill levels for different operating modes can be extremely different. Switching between the different operating modes can take place relatively quickly, because the fill level regulation must only be supplied or conveyed away to the minimum approximated amounts of fluid.

The reservoir capacity of the mixing container can be reduced and limited in the complete system to the maximum amount of fluid, whereby the cost-effectiveness increases. Given the use of only a single desired value (as this is the case in the prior art), the mixing container must be overdimensioned in order to be able to accept the entire amount of fluid if the entire system is pumped empty.

Although a preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim:

1. A method to operate a digital printer that has multiple developer stations operating with liquid developer, said developer stations being supplied with liquid developer of one color from a mixing container, and wherein a number of the developer stations participating in printing being dependent on a respective print operating mode, comprising the steps of:

during operation of no developer stations, supplying liquid developer to at least one developer station or all developer stations connected to the mixing container;

with a regulatory device keeping substantially constant a fill level of liquid developer in the mixing container depending on said print operating mode; and providing a desired different operating value for the fill level for the regulatory device depending on the print operating mode.

2. The method of claim 1 in which a reference variable as a desired value for the regulatory device is supplied during a transition time period, via which an abrupt transition of the fill level is avoided between successive print operating modes.

3. The method according to claim 2 in which a time curve of the reference variable has a low-pass response.

4. The method according to claim 2 in which the reference variable has a time curve in a form of a ramp with a predetermined rise or fall.

5. The method according to claim 4 in which the rise or the fall of the ramp is adjusted depending on a previous operating mode previous to a current print operating mode.

6. The method according to claim 4 in which a deviation of a real value and a reference variable is determined, and an error signal is generated upon exceeding a maximum value of the deviation.

7. A digital printer to print to a recording medium, comprising:

multiple developer stations operating with liquid developer, said developer stations being supplied with liquid developer from a mixing container;

a number of the developer stations participating in printing being dependent on a respective print operating mode;

a liquid developer supply unit to supply developer during operation of no developer stations to at least one developer station or all developer stations connected to the mixing container;

a regulatory device which keeps a fill level of liquid developer in the mixing container substantially constant depending on the print operating mode; and the regulatory device being provided a different desired operating mode value for the fill level depending on the print operating mode.

8. The digital printer according to claim 7 in which a filter unit determines a reference variable during a transition time period and by use of the reference variable an abrupt transition of the fill level between successive print operating modes is avoided.

9. The digital printer according to claim 8 in which the reference variable has a time curve in a form of a ramp with a predetermined rise or fall.

10. The digital printer according to claim 8 in which a deviation of a real value and the reference variable is determined, and an error signal is generated upon exceeding a maximum value of the deviation.

11. A method to operate a digital printer that has multiple developer stations operating with liquid developer, said developer stations being supplied with liquid developer from a mixing container, and wherein a number of the developer stations participating in printing being dependent on a respective print operation mode, comprising the steps of:

supplying liquid developer to at least one developer station connected to the mixing container;

with a regulatory device keeping substantially constant a fill level of liquid developer in the mixing container depending on said print operating mode; and providing a desired different operating value to the regulatory device for the fill level depending on the print operating mode.

12. A digital printer to print a recording medium, comprising:

multiple developer stations operating with liquid developer, said developer stations being supplied with liquid developer from a mixing container;

a number of the developer stations participating in printing being dependent on a respective print operating mode;

a liquid developer supply unit to supply developer to at least one developer station connected to the mixing container;

a regulatory device which keeps a fill level of liquid developer in the mixing container substantially constant depending on the print operating mode; and the regulatory device being provided a different desired operating mode value for the fill level depending on the print operating mode.

* * * * *